US010939764B1

(12) United States Patent
Tsai

(10) Patent No.: US 10,939,764 B1
(45) Date of Patent: Mar. 9, 2021

(54) FOLDING ROCKING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC., Taipei (TW)

( * ) Notice: Subject to any disclaimer, the term of this patent is extended or adjusted under 35 U.S.C. 154(b) by 0 days.

(21) Appl. No.: 16/672,713

(22) Filed: Nov. 4, 2019

(51) Int. Cl.
*A47C 4/28* (2006.01)
*A47C 3/029* (2006.01)
*A47C 4/04* (2006.01)

(52) U.S. Cl.
CPC ..... *A47C 4/04* (2013.01); *A47C 3/029* (2013.01)

(58) Field of Classification Search
CPC ..... A47C 3/029; A47C 4/286; A47C 4/22; A47C 5/10; A47C 3/02; A47C 3/023; A47C 4/28; A47C 3/0255; A47C 4/00
USPC ..... 297/32
See application file for complete search history.

(56) References Cited

U.S. PATENT DOCUMENTS 2,718,916 A * 9/1955 Borochoff ..... A47C 3/023 297/287
4,047,753 A * 9/1977 Uchida ..... A47C 3/029 297/32
4,674,795 A * 6/1987 Nelson ..... A47C 3/023 297/239
4,790,596 A * 12/1988 Shifferaw ..... A47C 3/021 248/628
5,499,857 A * 3/1996 Lynch, Jr. ..... A47C 4/286 297/16.2
5,813,727 A * 9/1998 Sugawa ..... A47C 1/024 297/411.42
6,439,656 B1 * 8/2002 Liu ..... A47C 3/029 297/271.6
6,616,237 B2 * 9/2003 Sonner ..... A47D 13/107 297/440.22
6,676,206 B2 * 1/2004 Brandschain ..... A47C 3/029 297/259.2
7,100,975 B1 * 9/2006 Zheng ..... A47C 3/029 297/271.6
D565,852 S * 4/2008 Wang ..... D6/348
8,893,326 B2 * 11/2014 Gooris ..... A47D 13/107 5/101
D728,949 S * 5/2015 Fang ..... D6/348
10,368,644 B1 * 8/2019 Haingaertner ..... A47C 4/28
2003/0214159 A1 * 11/2003 Brandschain ..... A47C 4/22 297/32
2004/0251729 A1 * 12/2004 Olson ..... A47C 3/04 297/452.14
2014/0232154 A1 * 8/2014 Chen ..... A47C 3/026 297/271.1

(Continued)

*Primary Examiner* — Shin H Kim
(74) *Attorney, Agent, or Firm* — Sehmeiser, Olsen & Watts, LLP

(57) ABSTRACT

A folding rocking chair includes a left arc bottom rod, a right arc bottom rod, a left front rod, a right front rod, a left rear rod, a right rear rod, a seat frame rod, a left armrest rod, a right armrest rod, a left front armrest support rod, a right front armrest support rod, a left first pivot connecting rod, a right first pivot connecting rod, a left second pivot connecting rod, a right second pivot connecting rod, a backrest rod, a left pivot connecting part, a right pivot connecting part, a left multilink part, a right multilink part, a seat frame support part and a backrest support part.

8 Claims, 14 Drawing Sheets

(56) References Cited

U.S. PATENT DOCUMENTS

2017/0156500 A1* 6/2017 Lv ..... A47C 1/14
2018/0332968 A1* 11/2018 Djankovich ..... A47C 7/425

* cited by examiner

FOLDING ROCKING CHAIR

BACKGROUND OF THE INVENTION

1. Field of the Invention

The present invention relates generally to a rocking chair, and more particularly to a folding rocking chair.

2. Description of the Related Art

Rocking chair is commonly used in general household furnishings. It usually uses arc bottom rod which is not parallel to the ground, so that the rocking chair can sway forward and backward on the floor, and provide a different sitting experience from the general fixed seat.

However, the existing rocking chair's arc bottom rod and the upper seat are fixed to each other, so the existing rocking chair is bulky, not only requires a large space for transportation, but also it is not easily stored due to bulk when the rocking chair is placed indoors.

BRIEF SUMMARY OF THE INVENTION

Therefore, in order to solve the problems caused by the bulky and difficult storage of the conventional rocking chair, the present invention provides a folding rocking chair.

To achieve the above and other objects, the present invention provides a folding rocking chair, comprising: a left arc bottom rod, a right arc bottom rod, a left front rod, a right front rod, a left rear rod, a right rear rod, a seat frame rod, a left armrest rod, a right armrest rod, a left front armrest support rod, a right front armrest support rod, a left first pivot connecting rod, a right first pivot connecting rod, a left second pivot connecting rod, a right second pivot connecting rod, a backrest rod, a left pivot connecting part, a right pivot connecting part, a left multilink part, a right multilink part, a seat frame support part and a backrest support part. Wherein, the lower end of the left front rod and the lower end of the left rear rod are pivotally connected to the left arc bottom rod, and the lower end of the right front rod and the lower end of the right rear rod are pivotally connected to the right arc bottom rod; the upper end of the left front rod and the lower end of the left front armrest support rod are connected to the left front end of the seat frame rod by the left pivot connecting part; the upper end of the right front rod and the lower end of the right front armrest support rod are connected to the right front end of the seat frame rod by the right pivot connecting part; the upper end of the left rear rod and the left lower end of the backrest rod are connected to the left rear end of the seat frame rod by the left multilink part; the upper end of the right rear rod and the right lower end of the backrest rod are connected to the right rear end of the seat frame rod by the right multilink part; the upper end of the left front armrest support rod is pivotally connected to the front end of the left armrest rod; the upper end of the right front armrest support rod is pivotally connected to the front end of the right armrest rod; the rear end of the left armrest rod is pivotally connected to the left side of the backrest rod; the rear end of the right armrest rod is pivotally connected to the right side of the backrest rod; the front end of the left first pivot connecting rod is pivotally connected to the upper end of the left front rod; the rear end of the left first pivot connecting rod is pivotally connected to the left lower end of the backrest rod; the front end of the right first pivot connecting rod is pivotally connected to the upper end of the right front rod; the rear end of the right first pivot connecting rod is pivotally connected to the right lower end of the backrest rod; the front end of the left second pivot connecting rod is pivotally connected to the middle section of the left first pivot connecting rod; the rear end of the left second pivot connecting rod is pivotally connected to the upper end of the left rear pivot rod; the front end of the right second pivot connecting rod is pivotally connected to the middle section of the right first pivot connecting rod; the rear end of the right second pivot connecting rod is pivotally connected to the upper end of the right rear rod; the seat frame support part is disposed on the seat frame rod, and the backrest support part is disposed on the backrest rod.

In an embodiment of the present invention, the left pivot connecting part includes a pivot connecting part, an extending part and a plug, the extending part is extended from the pivot connecting part and pivotally connected to the left front end of the seat frame rod and connected with the upper end of the left front rod, the lower end of the left front armrest support rod is pivotally connected to the pivot connecting part, and the plug is inserted into the pivot portion and the rod body of the left front armrest support rod.

In an embodiment of the present invention, the left pivot connecting part further includes a spring part and a button, the spring part is disposed on a pivot connecting part of the left pivot connecting part, and the two ends of the button are respectively connected to the spring part and the plug, and the two ends of the button are pivotally connected to the pivot connecting part of the left pivot connecting part.

In an embodiment of the present invention, the right pivot connecting part includes a pivot connecting part, an extending part and a plug, the extending part is extended from the pivot connecting part and pivotally connected to the right front end of the seat frame rod and connected with the upper end of the right front rod, the lower end of the right front armrest support rod is pivotally connected to the pivot connecting part, and the plug is inserted into the pivot portion and the rod body of the right front armrest support rod.

In an embodiment of the present invention, the right pivot connecting part further includes a spring part and a button, the spring part is disposed on a pivot connecting part of the right pivot connecting part, and the two ends of the button are respectively connected to the spring part and the plug, and the two ends of the button are pivotally connected to the pivot connecting part of the right pivot connecting part.

In an embodiment of the present invention, the upper end of the left multilink part is pivotally connected to the left lower end of the backrest rod, and the lower end of the left multilink part is pivotally connected to the upper end of the left rear rod, and the left rear end of the seat frame rod passes through the left multilink part. The upper end of the right multilink part is pivotally connected to the right lower end of the backrest rod, and the lower end of the right multilink part is pivotally connected to the upper end of the right rear rod, and the right rear end of the seat frame rod passes through the right multilink part.

In an embodiment of the present invention, the left multilink part is provided with a left backstop part to stop the left second pivot connecting rod; the right multilink part is provided with a right backstop part to stop the right second pivot connecting rod.

In an embodiment of the present invention, it further includes the plural fixing rods respectively connected between the left arc bottom rod and the right arc bottom rod, between the left front rod and the right front rod, and between the left rear rod and the right rear rod.

Thereby, in the folding rocking chair of the present invention, by the design of the left pivot connecting part, the right pivot connecting part, the left multilink part and the right multilink part, so that the rods can be pivot-folded relative to each other, thereby the rocking chair can be folded from the tridimensional unfolded state to the folded state, so the folding rocking chair can be greatly reduced in space, which is convenient for handling and home storage.

DETAILED DESCRIPTION OF THE INVENTION

Figure 1:
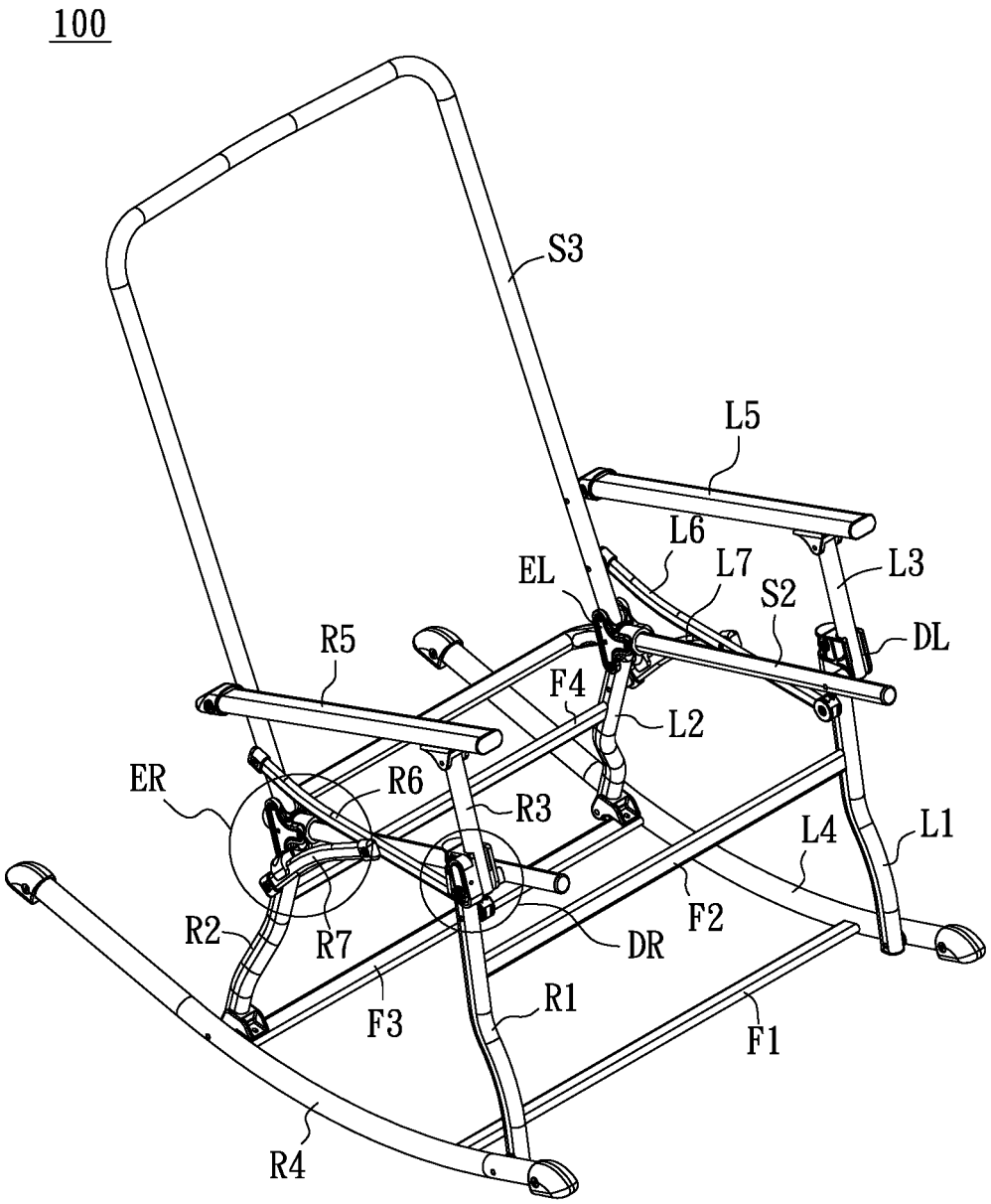
FIG. 1 is a three-dimensional schematic diagram of the folding rocking chair according to the embodiment of the present invention.
Figure 7:
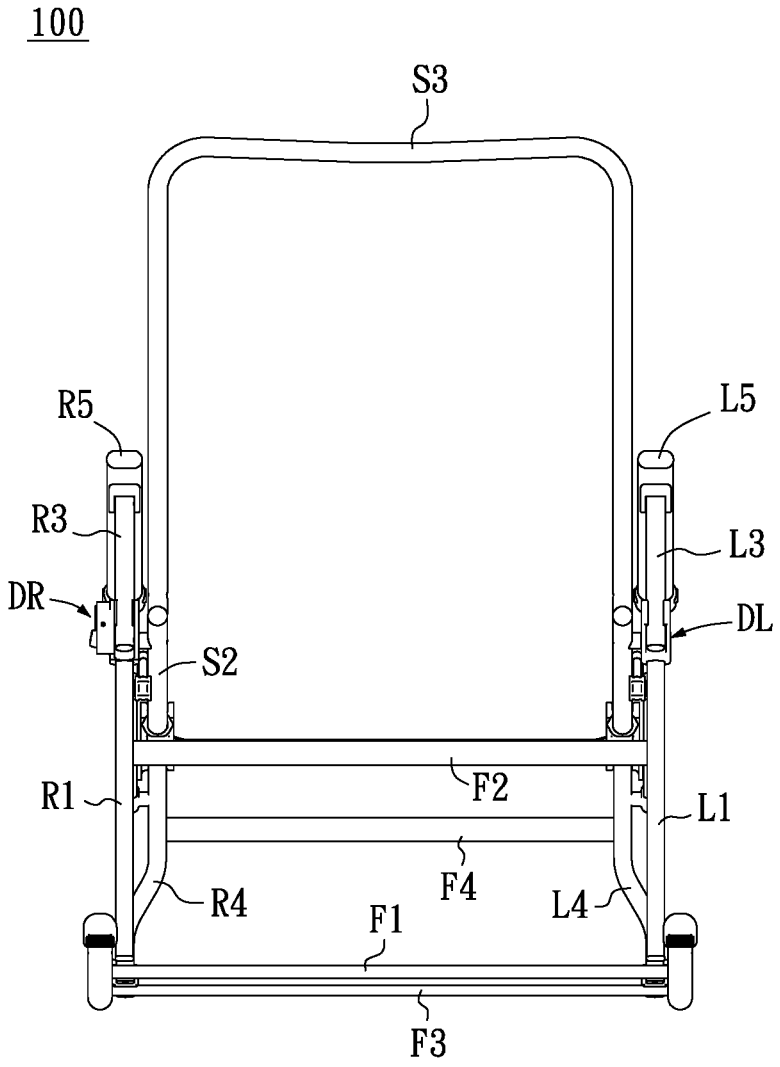
FIG. 7 is a front view of the folding rocking chair according to the embodiment of the present invention.
Figure 8:
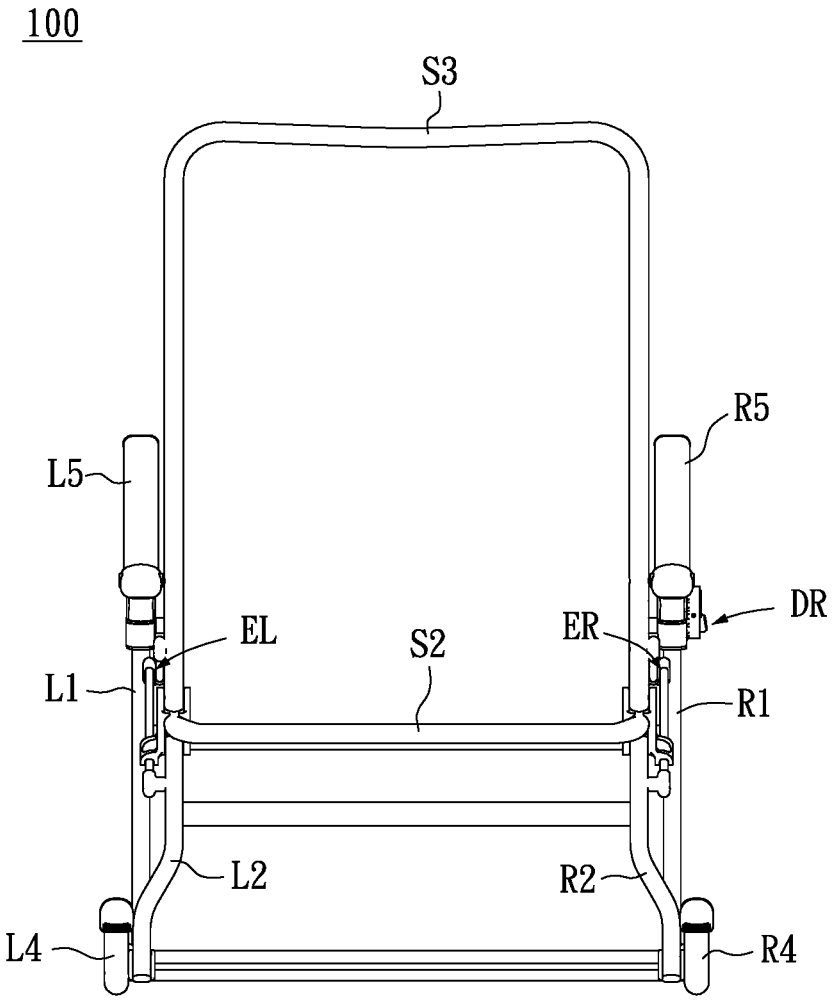
FIG. 8 is a rear view of the folding rocking chair according to the embodiment of the present invention.
Figure 9:
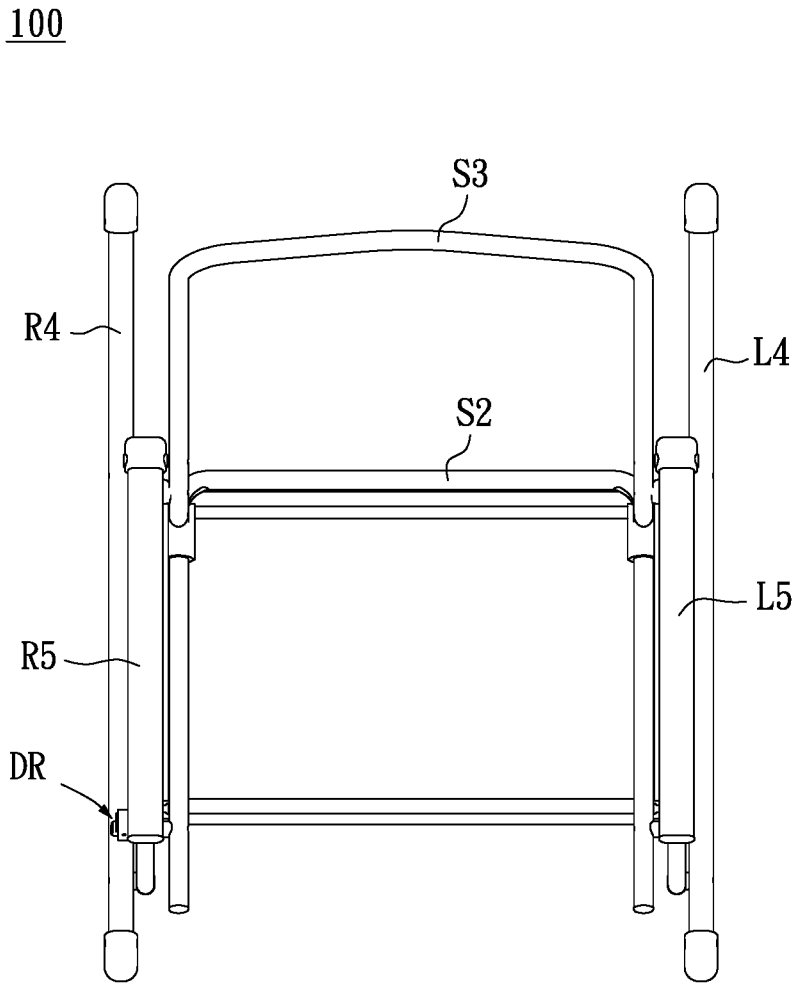
FIG. 9 is a top view of the folding rocking chair according to the embodiment of the present invention.
Figure 10:
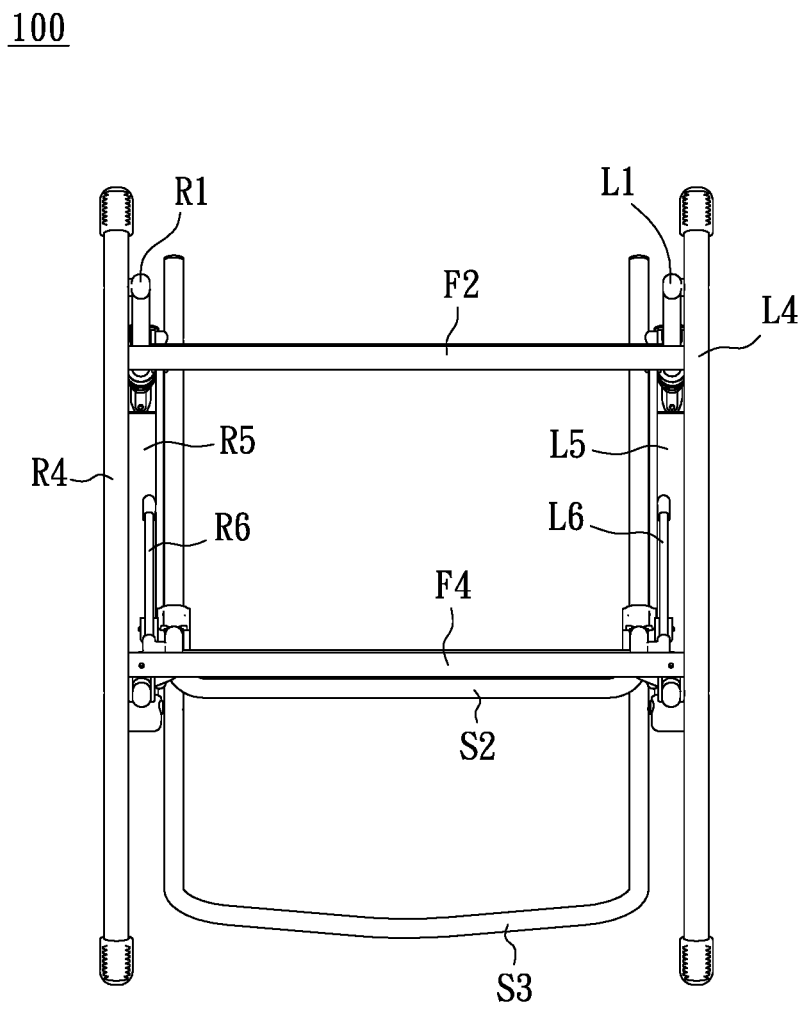
FIG. 10 is a top view of the folding rocking chair according to the embodiment of the present invention.
Figure 14:
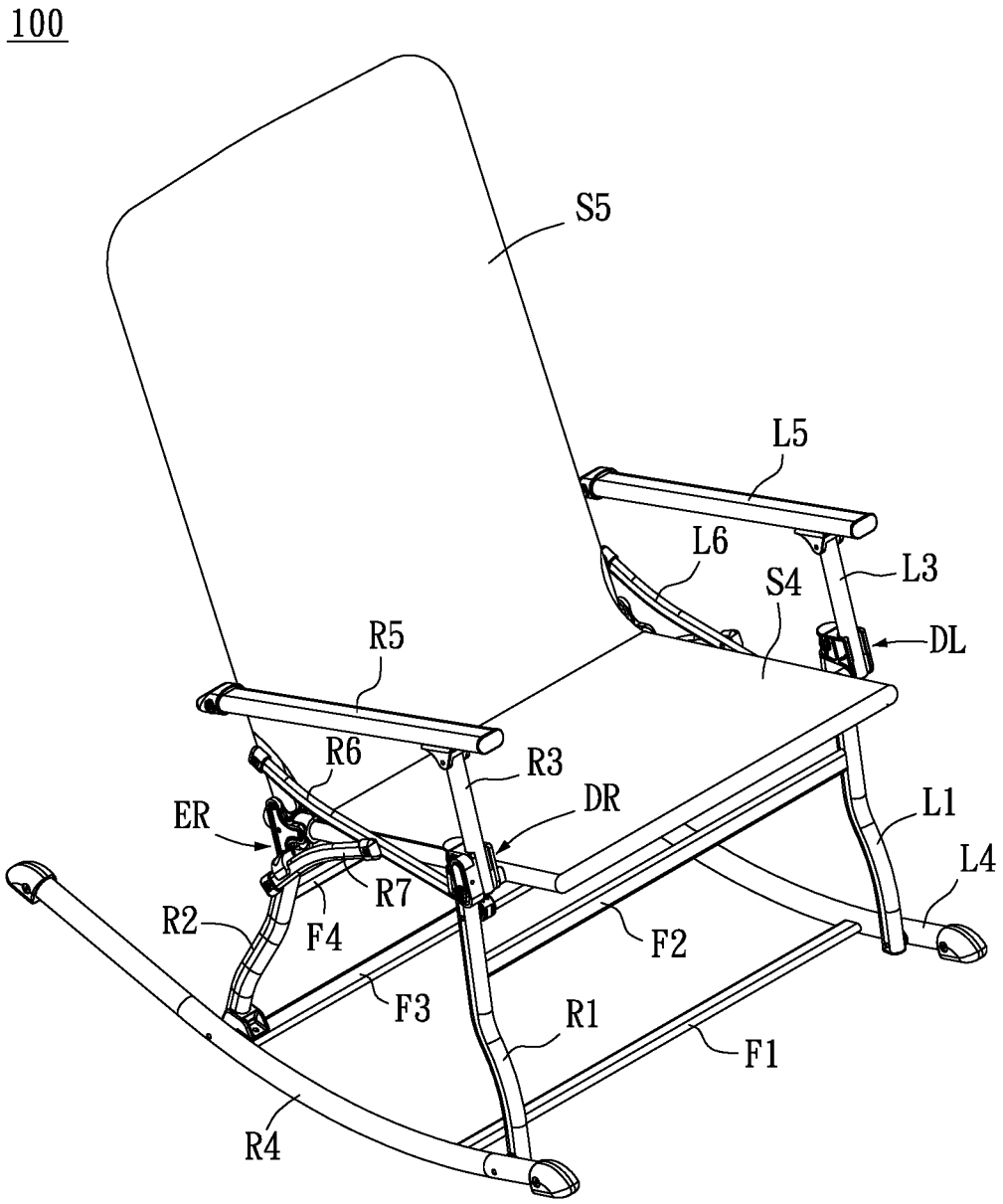
FIG. 14 is a three-dimensional schematic diagram of the support part of the folding rocking chair according to the embodiment of the present invention.

In order to fully understand the present invention, a detailed description of the present invention is given by means of the following specific embodiments and in conjunction with the accompanying schemata. Technicians in this field may understand the purpose, characteristics and efficacy of the present invention from the contents disclosed in the present specification. It should be noted that the present invention can be implemented or applied through various other specific embodiments, and various details in the present specification may also be based on different viewpoints and applications, and it can be modified and changed without departing from the spirit of the present invention . . . . The following embodiments will further elaborate the relevant technical contents of the present invention, but the disclosed contents are not intended to limit the scope of the patent application of the present invention. The following illustrations are as follows:

FIG. 1 and FIG. 14 are the three-dimensional schematic diagram of the folding rocking chair of the embodiment of the present invention; FIG. 7 FIG. 10 are the views, as shown in FIG. 1 and FIG. 14, FIG. 7 FIG. 10, the folding rocking chair 100 of the embodiment of the present invention includes: a left arc bottom rod L4, a right arc bottom rod R4, a left front rod L1, a right front rod R1, a left rear rod L2, a right rear rod R2, a seat frame rod S2, a left armrest rod L5, a right armrest rod R5, a left front armrest support rod L3, a right front armrest support rod R3, a left first pivot connecting rod L6, a right first pivot connecting rod R6, a left second pivot connecting rod L7, a right second pivot connecting rod R7, a backrest rod S3, a left pivot connecting part DL, a right pivot connecting part DR, a left multilink part EL, a right multilink part ER, a seat frame support part S4 and a backrest support part S5. The connections between the various components are as follows:

The lower end of the left front rod L1 and the lower end of the left rear rod L2 are pivotally connected to the left arc bottom rod L4, and the lower end of the right front rod R1 and the lower end of the right rear rod R2 are pivotally connected to the right arc bottom rod R4.

The upper end of the left front rod L1 and the lower end of the left front armrest support rod L3 are connected to the left front end of the seat frame rod S2 by the left pivot connecting part DL, the upper end of the right front rod R1 and the lower end of the right front armrest support rod R3 is connected to the right front end of the seat frame rod S2 by the right pivot connecting part DR.

The upper end of the left rear rod L2 and the left lower end of the backrest rod S3 are connected to the left rear end of the seat frame rod S2 by the left multilink part EL, and the upper end of the right rear rod R2 and the lower right end of the backrest rod S3 are connected to the right rear end of the seat frame rod S2 by the right multilink part ER.

The upper end of the left front armrest support rod L3 is pivotally connected to the front end of the left armrest rod L5, and the upper end of the right front armrest support rod R3 is pivotally connected to the front end of the right armrest rod R5, and the rear end of the left armrest rod L5 is pivotally connected to the left side of the backrest rod S3, the rear end of the right armrest rod R5 is pivotally connected to the right side of the backrest rod S3.

The front end of the left first pivot connecting rod L6 is pivotally connected to the upper end of the left front rod L1, and the rear end of the left first pivot connecting rod L6 is pivotally connected to the left lower end of the backrest rod S3, and the front end of the right first pivot connecting rod R6 is pivotally connected to the upper end of the right front rod R1, the rear end of the right first pivot connecting rod L6 is pivotally connected to the right lower end of the backrest rod S3.

The front end of the left second pivot connecting rod L7 is pivotally connected to the middle section of the left first pivot connecting rod L6, and the rear end of the left second pivot connecting rod L7 is pivotally connected to the upper end of the left rear pivot L2. The front end of the right second pivot connecting rod R7 is pivotally connected to the middle section of the right first pivot connecting rod R6, the rear end of the right second pivot connecting rod R7 is pivotally connected to the upper end of the right rear rod R2.

The seat frame support part S4 is disposed on the seat frame rod S2, the backrest support part S5 is disposed on backrest rod S3, the seat frame rod S2 can be U-shaped, and the backrest rod S3 can be U-shaped. The seat frame support part S4 and the backrest support part S5 can be the soft material such as cloth or plastic, and combined with the seat frame rod S2 to form a seat cushion, and combined with the backrest rod S3 to form a back cushion. However, the present invention is not limited thereto, and the seat frame support part S4 and the backrest support part S5 may also be other types.

Figure 5:
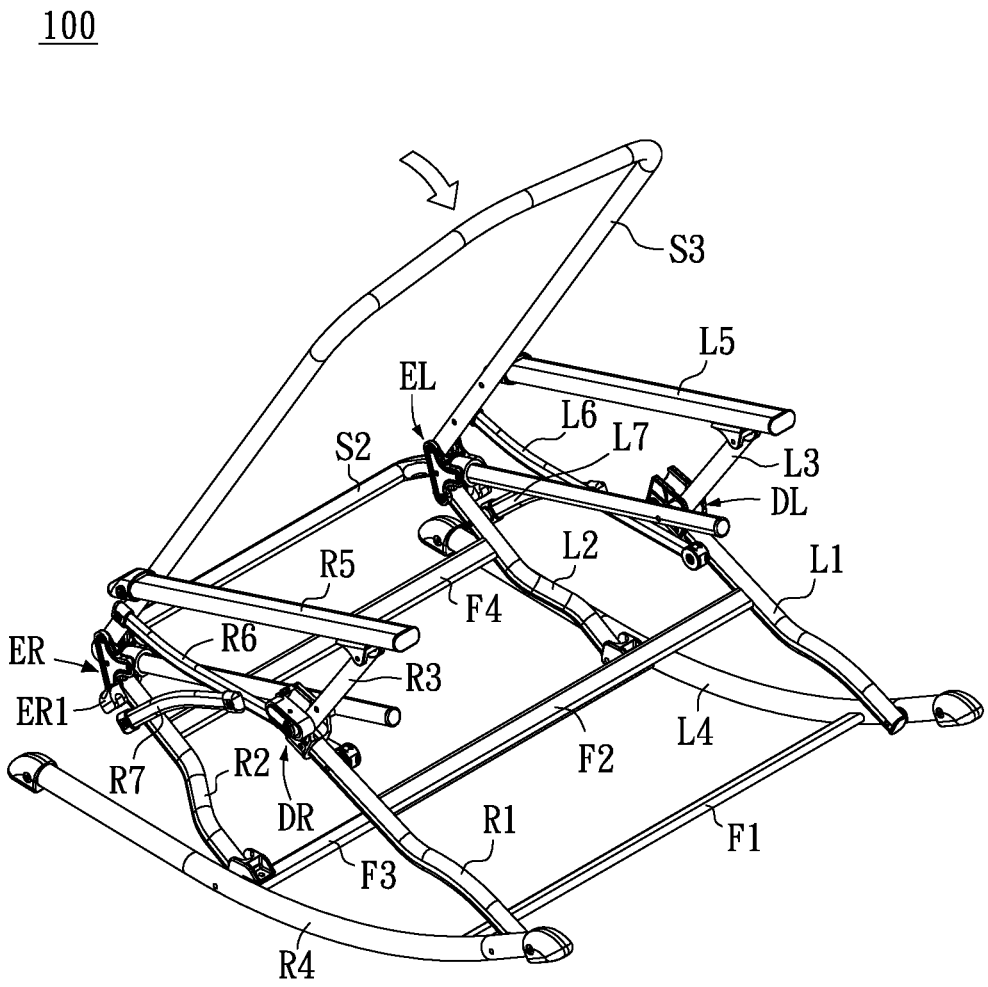
FIG. 5 is a three-dimensional schematic diagram of the folding process of the folding rocking chair according to the embodiment of the present invention.
Figure 6:
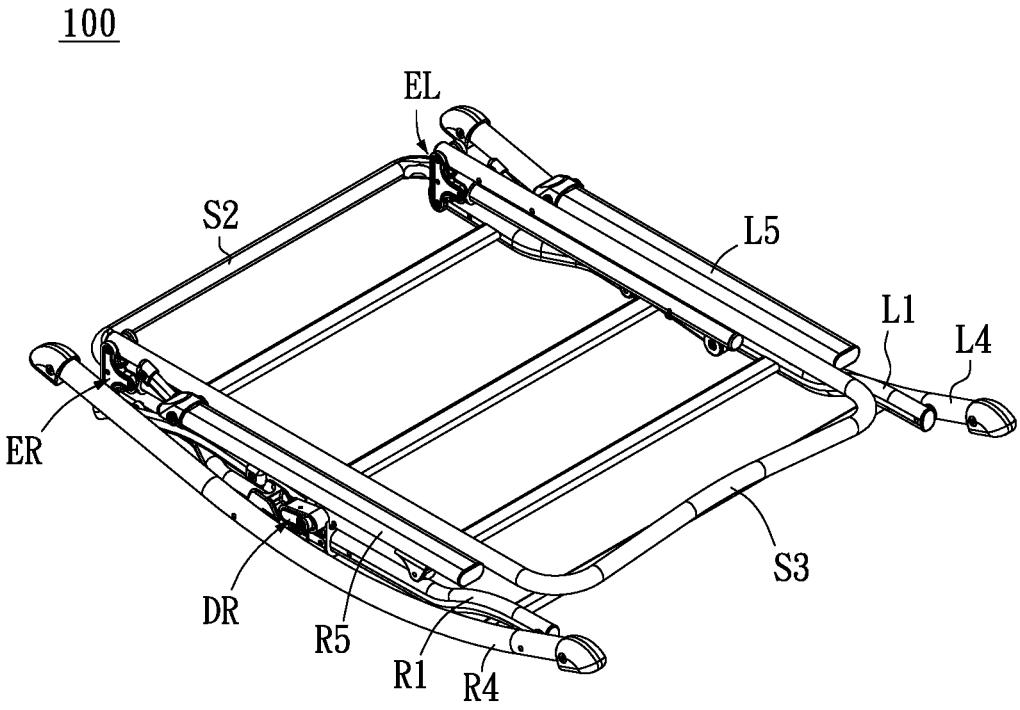
FIG. 6 is a three-dimensional schematic diagram of the folding result of the folding rocking chair according to the embodiment of the present invention.
Figure 11:
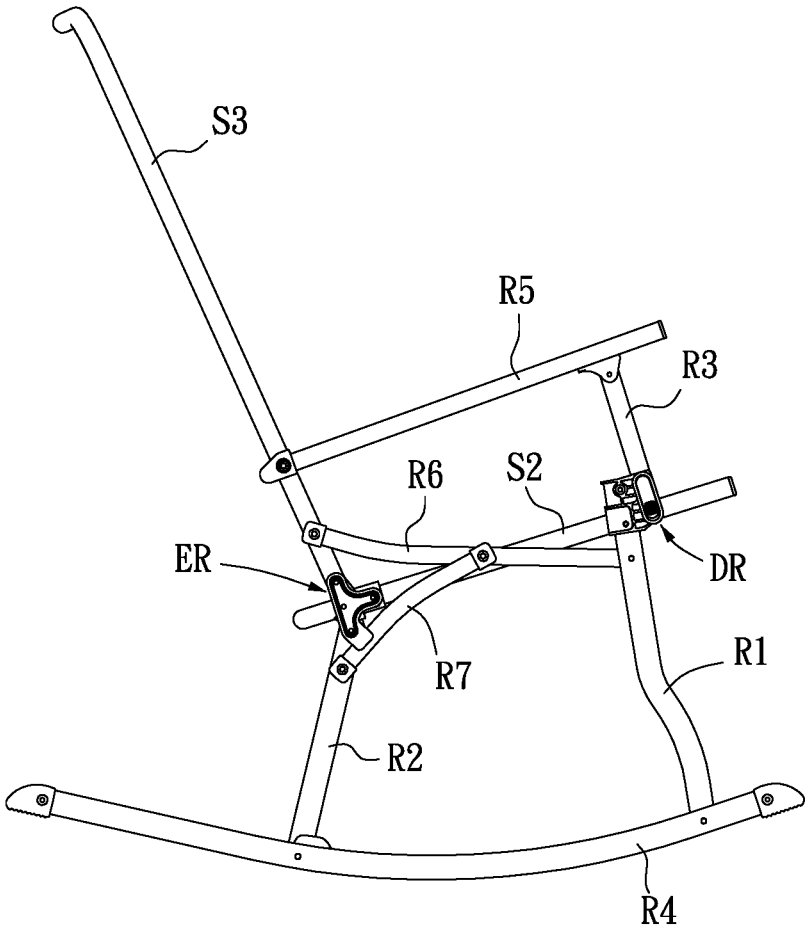
FIG. 11 is an upward view of the folding rocking chair according to the embodiment of the present invention.
Figure 12:
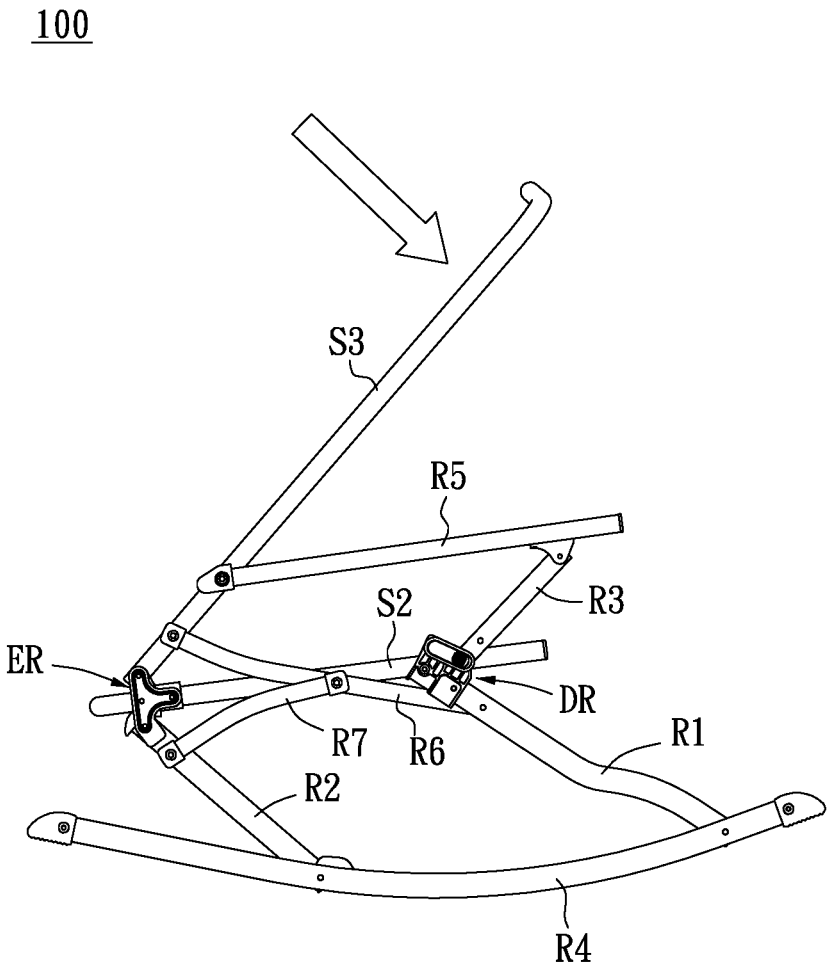
FIG. 12 is a right side view of the folding process of the folding rocking chair according to the embodiment of the present invention.
Figure 13:
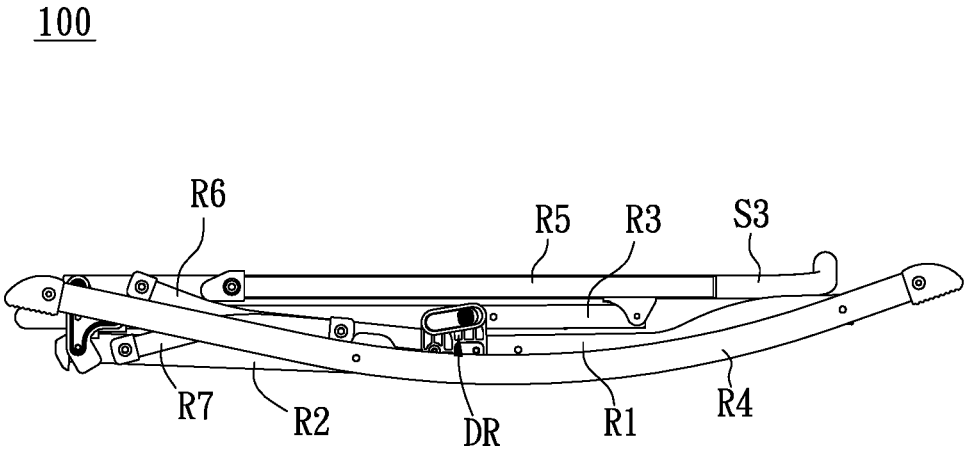
FIG. 13 is a right side view of the folding result of the folding rocking chair according to the embodiment of the present invention.

As shown in FIGS. 1, 5 and 6, with reference to FIG. 11 to FIG. 13, with the left pivot connecting part DL, the right pivot connecting part DR, the left multilink part EL and the right multilink part ER, the rods can be relatively bent. In detail, first the top of the backrest rod S3 is pushed forward to drive the left armrest rod L5, the right armrest rod R5, the left front armrest support rod L3 and the right front armrest support rod R3 leaned forwardly, and then connected to the left pivot connecting part DL, the left front rod L1 and the right front rod R1 of the right pivot connecting part DR are leaned backwardly. On the other hand, the left front rod L1 and the right front rod R1 are leaned backwardly also to drives the left first pivot connecting rod L6 and the right first pivot connecting rod R6, the left first pivot connecting rod L6 and the right first pivot connecting rod R6 also drive the left second pivot connecting rod L7 and right second pivot connecting rod R7, and then the left rear rod L2 and the right rear rod R2 are pivot-leaned backwardly relative to the left multilink part EL and the right multilink part ER, and the folding of the entire folding rocking chair 100 is completed.

Therefore, the three-dimensional unfolded state of FIG. 1 can be folded into the folded state of FIG. 6, which greatly reduces the occupied space, so that the folding rocking chair 100 can be easily handled and stored.

Figure 2:
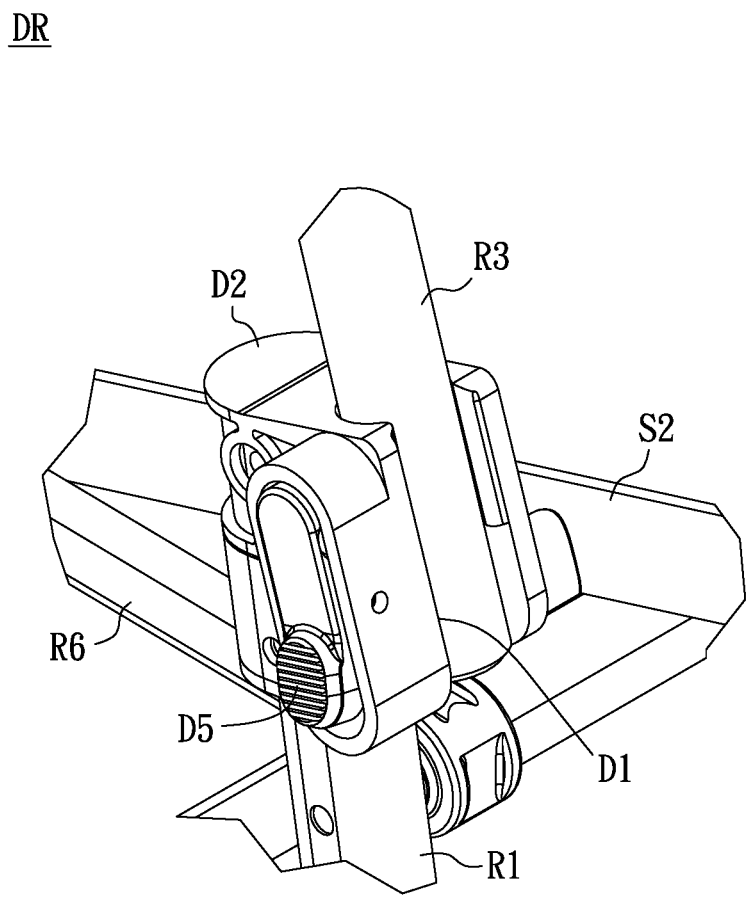
FIG. 2 is a three-dimensional schematic diagram of the right pivot connecting part of the folding rocking chair according to the embodiment of the present invention.

Further, referring to FIG. 2 to B, in this embodiment, the right pivot connecting part DR includes a pivot connecting part D1, an extending part D2 and a plug D3, and the extending part D2 is extended from the pivot connecting part D1 and pivotally connected to the right front end of the seat frame rod S2 and connected to the upper end of the left front rod L1, the lower end of the right front armrest support rod R3 is pivotally connected to the pivot connecting part D1 and connected with the upper end of the left front rod L1, the lower end of the right front armrest support rod R3 is pivotally connected to the pivot connecting part D1 that can be a pivoting slot, and the plug D3 is inserted in the pivot connecting part D1 and the rod body of the right front armrest support rod R3.

Figure 3A:
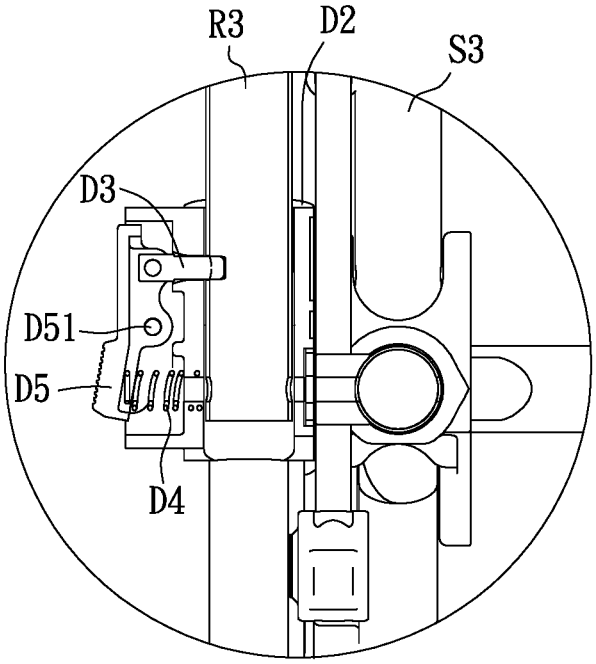
FIG. 3A is a sectional view of the right pivot connecting part of the folding rocking chair in the locked state according to the embodiment of the present invention.
Figure 3B:
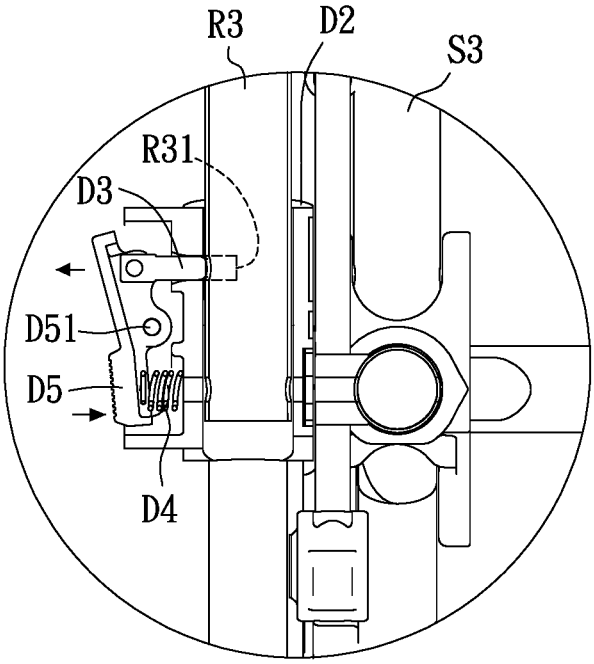
FIG. 3B is a sectional view of the right pivot connecting part of the folding rocking chair in the unlocked state according to the embodiment of the present invention.

As shown in FIG. 3A, when plug D3 is inserted in the slot R31 of the right front armrest support rod R3, the right front armrest support rod R3 is fixed on pivot connecting part D1 and cannot be pivoted, so the folding rocking chair 100 is fixed in the unfolded state as shown in FIG. 1. As shown in FIG. 3B, when plug D3 temporarily leaves the slot R31 of the right front armrest support rod R3, there is only one pivot connecting point between the right front armrest support rod R3 and the pivot connecting part D1. Therefore, the right front armrest support rod R3 can be pivoted relative to the pivot connecting part D1, and so that the folding rocking chair 100 can be in the folded state as shown in FIG. 5 and FIG. 6.

According to the structure of the right pivot connecting part DR described above, whether the plug D3 is inserted in the slot R31 of the right front armrest support rod R3, and the right front armrest support rod R3 is fixed, or the right front armrest support rod R3 can be pivoted freely, thereby achieving the purpose of fixing the folding rocking chair 100 in the unfolded state or in the folded state.

Further, in this embodiment, as shown in FIG. 3A and FIG. 3B, the right pivot connecting part DR further includes a spring part D4 and a button D5, and the spring part D4 is disposed on the outside of the pivot connecting part D1 of the right pivot connecting part DR, the two ends of the button D5 are respectively connected to the spring part D4 and the plug D3, and the two ends of the button D5 are pivotally connected to the outside of the pivot connecting part D1 of the right pivot connecting part DR.

The button D5 is provided with a support point D51. When one end of the button D5 connected to the spring part D4 is pressed by an external force, the other end of the button D5 relative to the support point D51, that is, the end connected with the plug D3 is lifted up according to the lever principle, the plug D3 is moved outwardly away from the slot R31, and the right front armrest support rod R3 is released from the fixed state and can be freely pivoted. Thus, the plug D3 can be easily drawn out from the slot R31 by pressing with an external force, and the elastic potential energy of the spring part D4 can restore the plug D3, so that the right front armrest support rod R3 can quickly and easily switch the fixed state and the pivoted state of the chair.

It should be noted that the foregoing embodiments of FIG. 2~FIG. 3B are exemplified by the right pivot connecting part DR, but the present invention is not limited thereto, and one of the left pivot connecting part DL and the right pivot connecting part DR may have the same structure. In the other embodiment, the left pivot connecting part DL and the right pivot connecting part DR are mirror-symmetric with the same structure.

Figure 4:
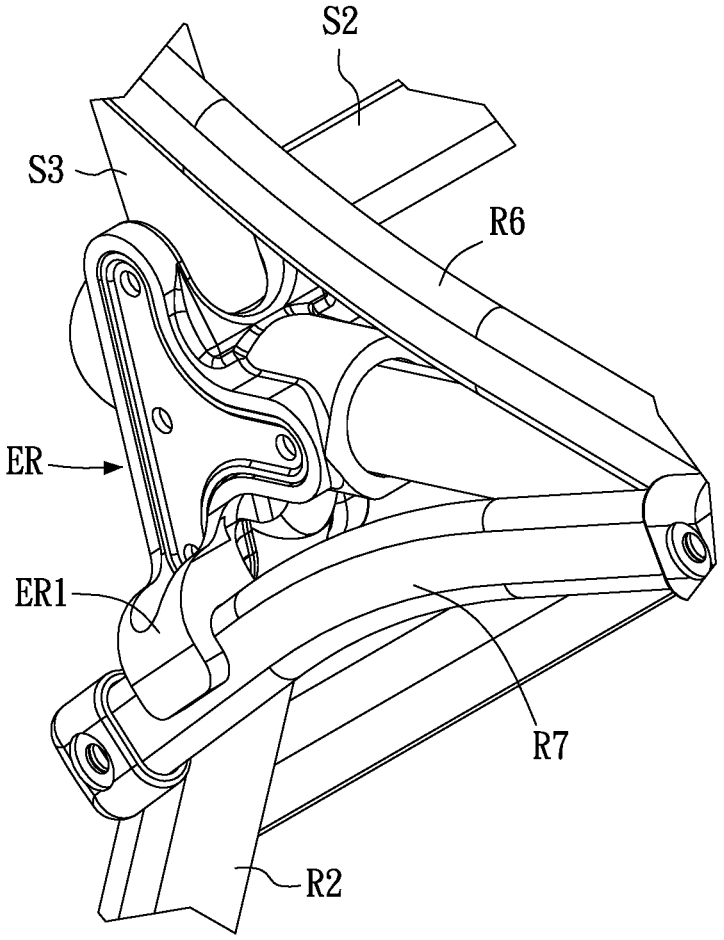
FIG. 4 is a three-dimensional schematic diagram of the right multilink part of the folding rocking chair according to the embodiment of the present invention.

Further, referring to FIGS. 1 and 4, in this embodiment, the right multilink part ER can be T-shaped, the upper end of the right multilink part ER is pivotally connected to the right lower end of the backrest rod S3, and the lower end of the right multilink part ER is pivotally connected to The upper end of the right rear rod R2, the right rear end of the seat frame rod S2 passes through the right multilink part ER, the left multilink part EL has a mirror-symmetrical structure, the left multilink part EL can be T-shaped, and the upper end of the left multilink part EL is pivotally connected the left lower end of the backrest rod S3, the lower end of the left multilink part EL is pivotally connected to the upper end of the left rear rod L2, and the left rear end of the seat frame rod S2 passes through the left multilink part EL.

Further, in the present embodiment, as shown in FIG. 4, the right multilink part ER is provided with a right backstop part ER1 to stop the right second pivot connecting rod R7; likewise, the left multilink part EL is provided with a left backstop part EL1 to stop the left second pivot connecting rod L7, so that the folding rocking chair 100 is more stable in the unfolded state.

Further, as shown in FIG. 1, the folding rocking chair 100 further includes the plural fixing rod F1, F2, F3 and F4. Wherein, the fixing rod F1 and F3 are connected between the left arc bottom rod L4 and the right arc bottom rod R4. The fixing rod F2 is connected between the left front rod L1 and the right front rod R1, and the fixing rod F4 is connected between the left rear rod L2 and the right rear rod R2. With these fixing rods F1, F2, F3 and F4, the folding rocking chair 100 maintains a stable structure without distortion.

Although the invention has been explained in relation to its preferred embodiment, it is to be understood that many other possible modifications and variations can be made without departing from the spirit and scope of the invention as hereinafter claimed.

What is claimed is:

1. A folding rocking chair, comprising: a left arc bottom rod, a right arc bottom rod, a left front rod, a right front rod, a left rear rod, a right rear rod, a seat frame rod, a left armrest rod, a right armrest rod, a left front armrest support rod, a right front armrest support rod, a left first pivot connecting rod, a right first pivot connecting rod, a left second pivot connecting rod, a right second pivot connecting rod, a backrest rod, a left pivot connecting part, a right pivot connecting part, a left multilink part, a right multilink part, a seat frame support part and a backrest support part, wherein, the lower end of the left front rod and the lower end of the left rear rod are pivotally connected to the left arc bottom rod, and the lower end of the right front rod and the lower end of the right rear rod are pivotally connected to the right arc bottom rod;

the upper end of the left front rod and the lower end of the left front armrest support rod are connected to the left front end of the seat frame rod by the left pivot connecting part, the upper end of the right front rod and the lower end of the right front armrest support rod are connected to the right front end of the seat frame rod by the right pivot connecting part;

the upper end of the left rear rod and the left lower end of the backrest rod are connected to the left rear end of the seat frame rod by the left multilink part, and the upper end of the right rear rod and the lower right end of the backrest rod are connected to the right rear end of the seat frame rod by the right multilink part;

the upper end of the left front armrest support rod is pivotally connected to the front end of the left armrest rod; the upper end of the right front armrest support rod is pivotally connected to the front end of the right armrest rod; the rear end of the right armrest rod is pivotally connected to the left side of the backrest rod, the rear end of the right armrest rod is pivotally connected to the right side of the backrest rod;

the front end of the left first pivot connecting rod is pivotally connected to the upper end of the left front rod, and the rear end of the left first pivot connecting rod is pivotally connected to the left lower end of the backrest rod, the front end of the right first pivot connecting rod is pivotally connected to the upper end of the right front rod, the rear end of the right first pivot connecting rod is pivotally connected to the lower right end of the backrest rod;

the front end of the left second pivot connecting rod is pivotally connected to the middle section of the left first pivot connecting rod; the rear end of the left second pivot connecting rod is pivotally connected to the upper end of the left rear rod; the front end of the right second pivot connecting rod is pivotally connected to the middle section of the right first pivot connecting rod R6, and the rear end of the right second pivot connecting rod is pivotally connected to the upper end of the right rear rod;

the seat frame support part is disposed on the seat frame rod, and the backrest support part is disposed on the backrest rod.

2. The folding rocking chair according to claim 1, wherein the left pivot connecting part includes a pivot connecting part, a extending part and a plug, the extending part is extended from the pivot connecting part and pivotally connected to the left front end of the seat frame rod and connected to the upper end of the left front rod, the lower end of the left front armrest support rod is pivotally connected to the pivot connecting part, and the plug is inserted into the pivot connecting part and the pivot body of the left front armrest support rod.

3. The folding rocking chair according to claim 2, wherein the left pivot connecting part DL further includes a spring part and a button, the spring part is disposed on the pivot connecting part of the left pivot connecting part, and the two ends of the button are respectively connected to the spring part and the plug, and the two ends of the button are connected to the pivot connecting part of the left pivot connecting part.

4. The folding rocking chair according to claim 1, wherein the right pivot connecting part includes a pivot connecting part, a extending part and a plug, the extending part is extended from the pivot connecting part and is pivotally connected to the right front end of the seat frame rod and connected to the upper end of the right front rod, the lower end of the right front armrest support rod is pivotally connected to the pivot connecting part, and the plug is inserted in the pivot connecting part and the pivot body of the right front armrest support rod.

5. The folding rocking chair according to claim 4, wherein the right pivot connecting part further includes a spring part and a button, the spring part is disposed on the pivot connecting part of the right pivot connecting part, and the two ends of the button are respectively connected to the spring part D4 and the plug, and the two ends of the button are pivotally connected to the pivot connecting part of the right pivot connecting part.

6. The folding rocking chair according to claim 1, wherein the upper end of the left multilink part is pivotally connected to the left lower end of the backrest rod, and the lower end of the left multilink part is pivotally connected to the upper end of the left rear rod, and the left rear end of the seat frame rod passes through the left multilink part, the upper end of the right multilink part is pivotally connected to the right lower end of the backrest rod, and the lower end of the right multilink part is pivotally connected to the upper end of the right rear rod, and the right rear end of the seat frame rod passes through the right multilink part.

7. The folding rocking chair according to claim 6, wherein the left multilink part is provided with a left backstop part to stop the left second pivot connecting rod; the right multilink part is provided with a right backstop part to stop the right second pivot connecting rod.

8. The folding rocking chair according to claim 1, further includes the plural fixing rods, which are respectively connected between the left arc bottom rod and the right arc bottom rod, between the left front rod and the right front rod, and between the left rear rod and the right rear rod.

* * * * *